United States Patent [19]

Paglia

[11] 4,302,634

[45] Nov. 24, 1981

[54] SPRING FORCE BIASING MEANS FOR A CAPACITANCE-TYPE ELECTROSTATIC TRANSDUCER

[75] Inventor: Richard Paglia, Carlisle, Mass.

[73] Assignee: Polaroid Corporation, Cambridge, Mass.

[21] Appl. No.: 146,311

[22] Filed: May 5, 1980

[51] Int. Cl.[3] ..... H04R 19/00
[52] U.S. Cl. ..... 179/111 R
[58] Field of Search ..... 179/111 R, 111 E

[56] References Cited

U.S. PATENT DOCUMENTS

| | | | |
|---|---|---|---|
| 3,595,661 | 7/1971 | Gold | 96/76 |
| 4,085,297 | 4/1978 | Paglia | 179/111 R |
| 4,174,164 | 11/1979 | Friedman et al. | 354/86 |

*Primary Examiner*—George G. Stellar
*Attorney, Agent, or Firm*—John J. Kelleher

[57] ABSTRACT

Conformity between a cooperatively engaged vibratile diaphragm and backplate of a capacitance-type electrostatic transducer assembly is improved, and unwanted mechanical vibrations in said backplate are substantially reduced, by means of a low cost, easily fabricated spring in engagement with the housing of said transducer assembly that presses on selected peripheral portions of said transducer backplate.

10 Claims, 7 Drawing Figures

SPRING FORCE BIASING MEANS FOR A CAPACITANCE-TYPE ELECTROSTATIC TRANSDUCER

BACKGROUND OF THE INVENTION

1. Field of the Invention

The present invention relates to a capacitance-type electrostatic transducer having a backplate in engagement with a vibratile diaphragm with the center of said backplate being subjected to a force, in general, and to such a transducer backplate whose center is subjected to a diaphragm tensioning force from a leaf spring, in particular.

2. Description of the Prior Art

Capacitance-type electrostatic transducers are well-known in the prior art. In such transducers, a diaphragm having an insulative layer and an electrically conductive layer has its insulative layer in contact with a grooved, irregular, electrically conductive backplate surface. A peripheral region of the diaphragm is maintained in a fixed position with respect to the transducer housing and a spring force urges said grooved backplate surface into cooperative engagement with said insulative diaphragm layer.

The insulative and electrically conductive layers of the diaphragm and the conductive surface of said backplate form a capacitor such that when a dc voltage is applied across the electrodes of said capacitor, irregularities in the grooved surface of the backplate set up localized concentrated electric fields in said insulative layer. When an ac signal is superimposed on said dc bias, the insulative layer is stretched such that oscillatory formations develop, causing an acoustical wavefront to be propagated from the diaphragm. The received acoustical wavefront impinging upon the insulative layer produces a variable voltage corresponding to said impinging wavefront across the capacitor electrodes.

The use of a single transducer for both signal transmission and signal reception necessitates desensitizing or "blanking" of receive signal circuitry during signal transmission in order to prevent said receive signal circuitry from confusing a transmit signal with an echo of said transmit signal. Such a desensitizing or "blanking" arrangement is described in U.S. Pat. No. 4,199,246, by J. MUGGLI.

An extremely important design consideration for the above-described type of transducer is obtaining the proper diaphragm tension. Diaphragm tensioning greatly influences transducer acoustical output magnitude and direction, reception sensitivity and resonant frequency, for example. The prior art discloses several arrangements for obtaining the desired amount of diaphragm tensioning.

In one such diaphragm tensioning arrangement described in U.S. Pat. No. 4,085,297 to PAGLIA, a transducer backplate is urged into cooperative engagement with a vibratile diaphragm by a leaf spring that applies a force to the center region of said backplate in order to achieve said cooperative engagement. A leaf-type diaphragm tensioning spring is low in cost, of minimum size, is easily fabricated and is readily assembled on a transducer body.

A problem believed to be associated with the use of a leaf spring or a spring arrangement in an electrostatic transducer where the diaphragm tensioning force is applied to the center region of a cooperating backplate, is the generation of spurious signals by said transducer due to the fact that the peripheral region of said backplate is cantilevered or is unsupported by a spring or any other force producing means. If such signals should occur after the receive circuitry is made sensitive to an echo of a previously transmitted signal, and these spurious signals are sensed by the transducer before it senses a true echo of said previously transmitted signal, these spurious signals will cause a false signal to be produced at the input to said receive circuitry that will appear to be an actual or true echo of said previously transmitted signal. This false signal may introduce an error into a system that utilizes an electrostatic transducer for both signal transmission and signal reception and also relies on the flight time from when a signal is transmitted and an echo of said signal is sensed by said transducer.

In U.S. patent application Ser. No. 101,425, filed Dec. 10, 1979, by R. PAGLIA, the applicant of the present invention, a capacitance-type electrostatic transducer is disclosed wherein the backplate and vibratile diaphragm of said transducer are urged into cooperative engagement with one another by means of a resilient spring and a force transferring disc having a circular raised portion at its periphery, interposed between said backplate and said spring. The raised portion of said disc makes circular backplate supporting contact with the periphery of said backplate to thereby substantially reduce unwanted backplate vibrations. While this particular disc/spring arrangement is effective for reducing backplate vibrations and improving diaphragm/backplate contact, it has certain undesirable aspects that increase the overall cost of a complete transducer assembly. For example, it takes more material and time to fabricate said disc/spring members than it takes to fabricate a single spring member. Also, additional labor is required in order to assemble said disc member on a transducer body.

SUMMARY OF THE INVENTION

In accordance with the teachings of the present invention, a capacitance-type electrostatic transducer having a vibratile diaphragm and a backplate with a surface designed for cooperative engagement with said diaphragm is provided with low cost, easily fabricated and assembled spring means in engagement with the housing of said transducer that applies a force to selected peripheral areas of said backplate to properly tension said vibratile diaphragm and improve conformity between said diaphragm and said backplate to thereby minimize unwanted backplate vibrations resulting from a lack of physical support at said backplate's periphery.

DESCRIPTION OF THE PREFERRED EMBODIMENTS

The inventive concept of the present invention will be described below with reference to an electrostatic transducer of the type disclosed in the above-cited PAGLIA application and therefore, in order to facilitate describing the present invention, the electrostatic transducer disclosed in said PAGLIA application will be described in some detail before describing the preferred embodiment of said inventive concept.

Figure 1A:
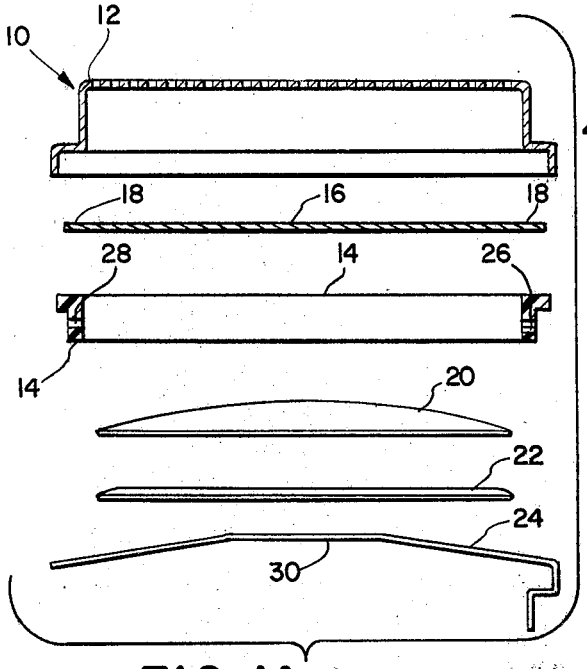
FIG. 1A (PRIOR ART)
FIG. 1A is an exploded view of an electrostatic transducer constructed in accordance with the prior art.
Figure 1B:
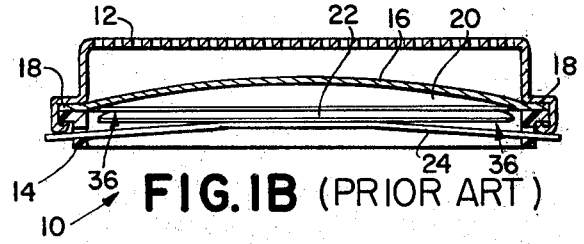
FIG. 1B (PRIOR ART)
FIG. 1B is a sectional view, in elevation, of the transducer of FIG. 1A, fully assembled.

Referring now to FIGS. 1A and 1B, exploded and elevational views of capacitance-type electrostatic transducer assembly 10 constructed in accordance with the teachings of the prior art, are depicted. Transducer assembly 10 includes metallic cover 12 of circular cross section, inner ring or housing member 14 of circular cross section and circular vibratile diaphragm 16 that has its peripheral region 18 crimped in a fixed relationship with respect to said cover 12 and said housing member 14. Diaphragm 16 is constructed of a relatively thin, dielectric film and one side of said dielectric film is coated with a thin layer of electrically conductive material, such as gold. Diaphragm 16 is oriented such that its electrically conductive diaphragm surface is in contact with electrically conductive or metallic cover 12 after peripheral region 18 of said diaphragm 16 is crimped in a fixed relation with respect to cover 12 and housing member 14.

Backplate 20, a substantially inflexible, relatively high inertia member, is of circular cross section, has a plain surface on one side and has a grooved and convex or crowned surface on the opposite side. All of the external surfaces of backplate 20 are electrically conductive and are in an electrically conductive relationship with respect to one another.

Loading disc 22 is a stiff member in the form of a circular stainless steel disc having a peripheral region that is uniformly offset from a plane that is coincident with the center portion of said disc 22. The diameter of disc 22 is slightly smaller than the cylindrical internal diameter of inner ring 14. The specific details of disc 22 and the manner in which it cooperates with other components of transducer assembly 10 will be discussed below in greater detail.

Leaf spring 24 has been formed such that it contains at least three continguous plane surfaces. Said spring 24 is an elongated resilient member, has tongue-like end portions with laterally extending shoulder portions near the ends thereof. One tongue-like end of said leaf spring 24 is normally in the form of an electrical lug (not shown) to facilitate connection to an external circuit.

Backplate 20 is inserted through the non-flanged end of inner ring 14 such that its grooved surface contacts the non-conductive surface of diaphragm 16. Loading disc 22 is then inserted through said non-flanged end of inner ring 14 with its raised peripheral region facing backplate 20. Disc 22 is moved into the non-flanged end of inner ring 14 until its raised peripheral region contacts the flat surface of backplate 20. Leaf spring 24 is inserted through T-shaped opening 26 and rectangular opening 28 in inner ring 14 until a tongue-like end portion of leaf spring 24 snaps down into the vertical portion of T-shaped opening 26. Openings 26 and 28 in inner ring 14 pass through the circular side wall portion of said inner ring 14 and are diametrically spaced from one another. Intermediate rectangular and planar surface portion 30 of leaf spring 24 presses on the center portion of disc 22 when said leaf spring 24 is properly positioned in openings 26, 28, thereby forcing said disc 22 into engagement with backplate 20 and said backplate 20 into engagement with the non-conductive surface of diaphragm 16, the force from said leaf spring 24 properly tensioning said diaphragm 16; the ends of leaf spring 24 being reacted against the sides of inner ring 14 openings 26 and 28.

Figure 2A:
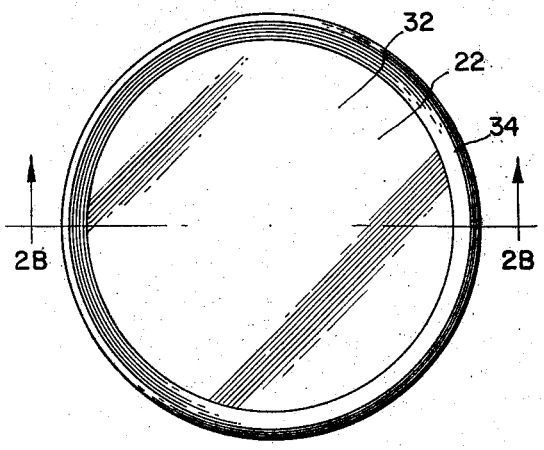
FIG. 2A (PRIOR ART)
FIG. 2A is a top view of the peripheral loading disc depicted in FIGS. 1A and 1B.
Figure 2B:
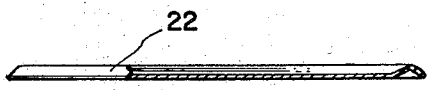
FIG. 2B (PRIOR ART)
FIG. 2B is an elevational view, partially in section, taken along the line 2B—2B in FIG. 2A.

Enlarged top and elevational views of loading disc 22 positioned between force producing leaf spring 24 and backplate 20 in transducer assembly 10, are shown in FIGS. 2A and 2B. With reference to FIGS. 2A and 2B and as mentioned above, loading disc 22 is a circular stainless steel member having a planar center region 32 and a peripheral region 34 that is uniformly offset from a plane through said planar region 32. A cross section of uniformly offset portion 34 of disc 22 is shown in FIG. 2B. This offset portion is in the form of a circular groove that makes circular contact with the flat non-grooved surface of backplate 20 when fully inserted in housing 14 of transducer assembly 10. When the offset portion of disc 22 is urged into contact with backplate 20 by leaf spring 24, the force produced by said leaf spring 24 is initially directed toward the center of backplate 20. However, loading disc 22 precludes said leaf spring force from being applied directly to the center of backplate 20 as it redirects said spring force, uniformly, to the backplate's peripheral region at, for example 36. By so redirecting said leaf spring force, the backplate's peripheral region is firmly supported and is in improved conformity with vibratile diaphragm 16 and therefore, transducer assembly 10 is less likely to produce spurious signals than a transducer assembly wherein such spring forces are applied to the center region of a capacitance electrostatic transducer backplate. However, the above-described prior device that is depicted in FIGS. 1A, 1B, 2A and 2B require two separate structural members with the attendant disadvantages noted above.

Figure 3A:
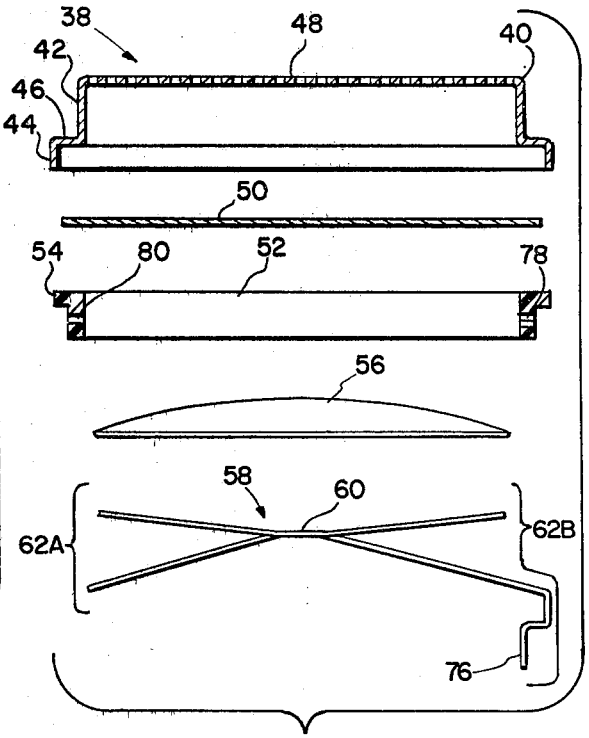
FIG. 3A is an exploded view of an electrostatic transducer constructed in accordance with the present invention.
Figure 3B:
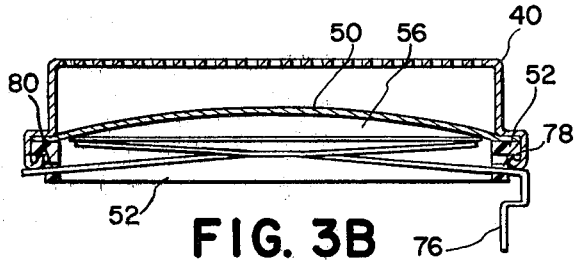
FIG. 3B is a sectional view, in elevation, of the transducer of FIG. 3A, fully assembled.

Turning now to the present invention, in FIGS. 3A and 3B, exploded and elevational views of capacitance-type electrostatic transducer assembly 38 constructed in accordance with a preferred embodiment of the present invention, is depicted. Transducer assembly 38 includes cylindrical cover 40, of circular cross-section, having two cylindrical portions 42 and 44 of different diameters. Shoulder 46 of cover 40, lies in a plane that is parallel to screen end 48 of said cover 40, and separates small diameter portion 42 from said larger diameter portion 44.

Vibratile diaphragm 50, constructed of relatively thin dielectric material, having electrically conductive and electrically non-conductive surfaces, is placed into the open end of cover 40 to the point where an annular region of said diaphragm 50 uniformly rests on shoulder 46 of said cover 40 with its electrically conductive surface adjacent the screened end of cover 40 and its peripheral region in electrical contact with shoulder 46 of said cover 40.

Inner ring or housing member 52, which is the main support housing of transducer assembly 38, is of cylindrical shape, is of circular cross-section, and has flange 54 extending laterally outward from one end thereof. The cylindrical shape of inner ring 52 forms the housing sidewall portion referred to herein. Flanged end of inner ring 52 is inserted into the open end of cover 40 to the point where flange 54 uniformly presses on the non-conductive surface of diaphragm 50. The periphery of diaphragm 50 and flange 54 of inner ring 52 are then placed in a fixed position with respect to cover 40 by bending the open end of large diameter portion 44 over flange 54 such that cover 40 and diaphragm 50 are crimped to said flange 54.

Backplate 56, a substantially inflexible, relatively high-inertia member, is of circular cross section, has a plane surface on one side and has a grooved and curved on the side opposite said plane surface side. All of the external surfaces of backplate 56 are electrically conductive and are in an electrically conductive relationship with respect to one another. The above-mentioned curved surface of backplate 56 is also referred to herein as the crowned or convex surface of said backplate 56.

Figure 4:
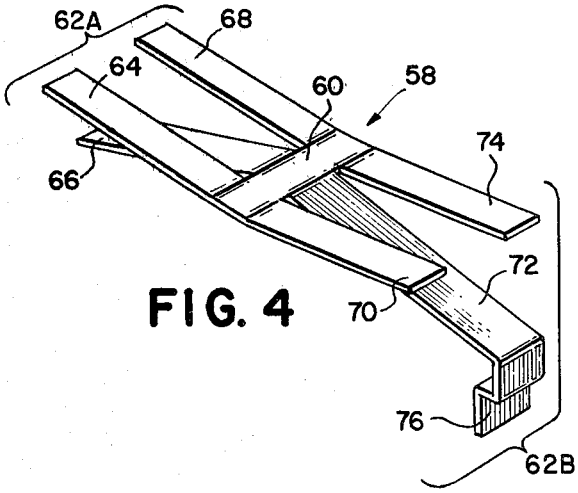
FIG. 4 is a perspective view of the multiple prong leaf spring depicted in FIGS. 3A and 3B.

Leaf spring 58 is an elongated, resilient, electrically conductive member having flat center portion 60 and forked end portions 62*a*, 62*b* at opposite ends thereof. As shown in FIG. 4, each end of leaf spring 58 has three prongs with adjacent prongs being bent in opposite directions with respect to one another. Forked end portion 62*a* includes prongs 64, 66 and 68, and forked end portion 62*b* includes prongs 70, 72 and 74. Center prong 66 is longer than prongs 64, 68, and center prong 72 is longer than prongs 70, 74. The end of center prong 72 is an electrical lug 76 that connects spring 58 to an external electrical circuit (not shown). p Referring now to FIGS. 3A, 3B and 4, backplate 56 is inserted through the non-flanged end of inner ring 52 such that its grooved surface contacts the non-conductive surface of diaphragm 50. Prongs 64, 66 and 68 of forked end portion 62*a* of resilient leaf spring 58 are compressed into a common plane and then said end portion 62*a* is inserted through T-shaped opening 78 in inner ring 52 until center prong 66 enters rectangular opening 80 in said inner ring 52, which is diametrically opposite T-shaped opening 78, and until prongs 70, 74 of forked end portion 62*b* exit from T-shaped inner ring 52 opening 78 and spring up into engagement with the flat non-grooved planar surface of backplate 56. In this position, center prongs 66 and 72 engage the bottom portions of openings 80, 78, respectively, and prongs 64, 68, 70 and 74 press on peripheral areas of the planar surface of backplate 56 to thereby urge the grooved, crowned surface of said backplate 56 into the desired cooperative engagement with the non-conductive surface of vibratile diaphragm 50. In addition, backplate 56 is supported by leaf spring 58 such that unwanted spurious signal generating mechanical vibrations of said backplate 56 are precluded.

DISCUSSION

In prior art electrostatic transducer assembly 10 depicted in FIGS. 1A and 1B, backplate-to-diaphragm cooperative engagement forces and diaphragm tensioning forces supplied by leaf spring 24 are uniformly directed to the entire periphery of backplate 20 by loading disc 22 interposed between leaf spring 24 and said backplate 20. As explained above, loading disc 22 has a circular groove at its periphery that offsets said periphery from a plane that includes the center portion of said loading disc 22 and that makes circular contact with said backplate 20 when the raised periphery of loading disc 22 is moved into engagement with the flat or planar surface of backplate 20 by leaf spring 24. Forces generated by leaf spring 24 that would otherwise be directly applied to the center of backplate 20 are directed instead to the peripheral portion of backplate 20 that is in contact with loading disc 22 through the circular groove portion of said loading disc 22. The force generated by leaf spring 24 is precluded from being applied directly to the center of backplate 20 by having the center of disc 22 spaced from the center of backplate 20.

Supporting the backplate periphery with the combination of leaf spring 24 and loading disc 22 prevents the generation of mechanical vibrations in backplate 20 and unwanted spurious signals that are produced by such vibrations. However, such a support arrangement increases the overall cost of a transducer assembly by the added cost of disc 22 and the labor to assemble said disc 22 on a transducer body over that of a transducer assembly not utilizing a loading disc.

The Applicant of the present invention has determined that support of the entire backplate periphery, as in prior art transducer assembly 10 is not necessary in order to avoid the unwanted spurious signal generating mechanical vibrations mentioned above. It has been determined that, if a backplate of a capacitance-type transducer is supported in as few as three but preferably, four locations, unwanted blackplate vibrations can also be avoided. It has also been determined that a single member can be constructed such that it generates the forces necessary to move backplate 56 into the desired cooperative engagement with vibratile diaphragm 50, and support the periphery of backplate 56 such that the above-mentioned unwanted backplate vibrations do not occur. That single member is multipleprong leaf spring 58 described in the preferred embodiment and shown in FIG. 4. Prongs of end portions 62*a*, 62*b* of leaf spring 58 can be readily formed and bent by conventional automatic fabricating equipment whose cost does not significantly effect overall leaf-spring cost. In addition, when leaf spring 58 is properly mounted on transducer assembly 38 and prongs 64, 68, 70 and 74 of leaf spring 58 are in contact with backplate 56, leaf spring 58 becomes trapped within inner ring 52 of transducer assembly 38 in an interlocking relationship, which prevents said spring 58 from detaching itself from said transducer assembly 38 and adversely affect transducer assembly 38 operation.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. An electrostatic transducer assembly comprising:

a housing having a hollow interior;

a vibratile diaphragm extending across said interior of said housing with a peripheral region of said diaphragm maintained in fixed relation to said housing;

a backplate positioned within said housing; and means for urging said backplate into cooperative engagement with said diaphragm, said urging means including a biasing member located within said housing adjacent the side of said backplate opposite said diaphragm and extending across the interior of said housing, said member having at least a pair of resilient end sections, each of said end sections having a first portion in engagement with said housing and a second portion in engagement with a peripheral region of said backplate, at least one of said first or second portions being bent away from the other portion in a plane generally normal to said backplate so as to bias said backplate toward said diaphragm.

2. The apparatus of claim 1, wherein said biasing member is a leaf spring and said end sections are at opposite ends of said leaf spring.

3. The apparatus of claim 2, wherein said end sections have forked ends with a plurality of prongs with adjacent prongs being bent at their roots in opposite directions with respect to one another.

4. The apparatus of claim 3, wherein at least one prong at each end is longer than the other end section prongs with said longer prongs being in engagement with said housing and the relatively shorter end section prongs pressing on said backplate to thereby urge said backplate into cooperative engagement with said diaphragm.

5. The apparatus of claim 3, wherein each of said forked end sections have three prongs.

6. The apparatus of claim 3, wherein said leaf spring and said housing are in a leaf spring movement limiting interlocking relationship when said leaf spring is properly positioned on said transducer assembly.

7. An electrostatic transducer assembly comprising:

a housing having a hollow interior;

a vibratile diaphragm extending across the interior of said housing with a peripheral region of said diaphragm maintained in a fixed position with respect to said housing;

a backplate movably positioned within said housing; and means for urging said backplate into engagement with said diaphragm, said means including a resilient member having a plurality of forked portions projecting therefrom with at least one prong of each of said forked positions engaging said housing and with at least one prong of each of said forked portions pressing on a peripheral area of said backplate.

8. The apparatus of claim 7, wherein said resilient member is a leaf spring and said forked positions are at opposite ends of said leaf spring.

9. The apparatus of claim 8, wherein each forked portion has three prongs with one prong of each forked portion being in engagement with said housing and with two prongs of each end portion pressing on said backplate.

10. The apparatus of claim 8, wherein said leaf spring and said housing are in a leaf spring movement limiting interlocking relationship when said leaf spring is properly positioned on said transducer assembly.

* * * * *